US006725508B1

(12) United States Patent
Noda et al.

(10) Patent No.: US 6,725,508 B1
(45) Date of Patent: Apr. 27, 2004

(54) CLIP

(75) Inventors: Masao Noda, Tokyo (JP); Yuji Shirakawa, Tokyo (JP); Shigenobu Nirei, Tokyo (JP)

(73) Assignee: Nirei Industry Co., Ltd. (JP)

( * ) Notice: Subject to any disclaimer, the term of this patent is extended or adjusted under 35 U.S.C. 154(b) by 0 days.

(21) Appl. No.: 09/422,995

(22) Filed: Oct. 21, 1999

(30) Foreign Application Priority Data

Oct. 22, 1998 (JP) ..... 10-301416

(51) Int. Cl.[7] ..... B42F 1/10; B42F 1/02

(52) U.S. Cl. ..... 24/545; 24/554; 24/67.9; 24/67 R; 24/67.3

(58) Field of Search ..... 402/80; 281/45; 24/554, 555, 545, 563, 487, 67.9, 67.11, 485, 486, 530, 546, 547, 565, 564, 570

(56) References Cited

U.S. PATENT DOCUMENTS

| | | | | | |
|---|---|---|---|---|---|
| 1,439,138 | A | * | 12/1922 | White | 24/67.9 |
| 2,025,848 | A | * | 12/1935 | Collis | 85/8 |
| 2,329,974 | A | * | 9/1943 | Bennet | 24/66 |
| 2,464,015 | A | * | 3/1949 | Young | 24/137 |
| 2,493,503 | A | * | 1/1950 | Renne | 24/137 |
| 2,785,919 | A | * | 3/1957 | Grondzik | 294/5.5 |
| 3,039,647 | A | * | 6/1962 | Rasmussen | 220/30 |
| 3,099,269 | A | * | 7/1963 | Sorensen | 129/37 |
| 3,282,657 | A | * | 11/1966 | Bright | 29/183.5 |
| 3,600,764 | A | * | 8/1971 | Froehlich, Jr. | 24/137 R |
| 3,873,286 | A | * | 3/1975 | Wurtenberg | 55/378 |
| 3,955,296 | A | * | 5/1976 | Kapstad | 40/11 R |
| 4,706,342 | A | * | 11/1987 | Yu | 24/67.9 |
| 4,904,104 | A | * | 2/1990 | Gloeckle | 402/80 |
| 5,226,676 | A | * | 7/1993 | Su | 281/45 |
| 5,765,873 | A | * | 6/1998 | Chen | 281/45 |
| 5,865,469 | A | * | 2/1999 | Chin | 281/45 |
| 6,018,850 | A | * | 2/2000 | Lorber | 24/67.9 |

FOREIGN PATENT DOCUMENTS

| | | | | |
|---|---|---|---|---|
| CH | 115 080 | * | 10/1945 | 24/67.3 |
| CH | 116 814 | * | 7/1946 | 24/67.9 |
| DE | 40 36 882 C 1 | | 6/1992 | |
| EP | 0 943 454 A1 | * | 9/1999 | |
| GB | 2 092 525 A | * | 8/1982 | |
| GB | 2 227 047 A | * | 7/1990 | 24/67.9 |
| JP | 7-769 | | 1/1995 | |
| WO | WO 97/17210 | | 5/1997 | |

* cited by examiner

*Primary Examiner*—Robert J. Sandy
*Assistant Examiner*—Ruth C. Rodriguez
(74) *Attorney, Agent, or Firm*—Lerner, David, Littenberg, Krumholz & Mentlik, LLP

(57) ABSTRACT

A first support element and a second support element are arranged opposite to each other. A connection element is arranged so as to connect one ends of the first and second support element to each other therethrough, so that the first support element, second support element and connection element cooperate together to form a substantially U-shape in section. A press element is formed at a free end of the second support element in a manner to be extended from the free end through a hinge groove. The press element is inwardly bent at the hinge groove to abut at a distal end thereof against an inner surface of the first support element, so that papers or the like are inserted between the first support element and the press element, resulting in the papers or the like being firmly interposedly held by the clip.

9 Claims, 5 Drawing Sheets

CLIP

BACKGROUND OF THE INVENTION

This invention relates to a clip, and more particularly to a clip for interposedly holding papers or the like.

There have been conventionally known a variety of clips for clipping or interposedly holding papers, newspapers or the like. However, such conventional clips each fail to be simplified in structure. One of the conventional clips is disclosed in Japanese Utility Model Application Laid-Open Publication No. 769/1995. The disclosed clip, as shown in FIGS. 2 and 3 of the publication, includes a clip body formed to have a U-shape and a discrete press contact member formed to have a substantially V-shape and fitted in the clip body. The publication states that the clip positively holds newspapers or the like when they are interposedly inserted between the clip body and the press contact member.

Unfortunately, the disclosed clip fails to exhibit sufficient pressing force with respect to papers clipped because the press contact member is previously formed to have a substantially V-shape by bending. Also, the disclosed clip causes papers clipped to readily fall out of the clip when they are drawn out of the clip, because an angle defined between the press contact member and the papers is small, resulting in contact friction therebetween being decreased.

SUMMARY OF THE INVENTION

The present invention has been made in view of the foregoing disadvantage of the prior art.

Accordingly, it is an object of the present invention to provide a clip which is capable of positively clipping papers or the like (hereinafter referred to as "papers") while being simplified in structure.

In accordance with the present invention, a clip is provided. The clip includes a first support element having one end and the other end acting as a free end, as well as a second support element having one end and the other end acting as a free end. The first and second support elements are arranged opposite to each other. The clip also includes a connection element arranged so as to connect the one ends of the first support element and second support element to each other therethrough, so that the first support element, second support element and connection element cooperate together to form a substantially U-shape in section. The clip further includes a press element formed at the free end of the second support element in a manner to be extended from the free end of the second support element through a hinge groove. The press element is inwardly bent at the hinge groove to abut a distal end thereof against an inner surface of the first support element. Thus, papers or the like are inserted between the first support element and the press element, resulting in the papers or the like being firmly interposedly held by the clip.

In a preferred embodiment of the present invention, the first support element and second support element are arranged so as to define a space therebetween which is broad on a connected side of the clip and narrow on an open side of the clip.

In a preferred embodiment of the present invention, the first support element and second support element are each formed on an outside thereof with a respective held element in a manner to be projected therefrom. A space between the first support element and the press element is expanded by pinching the held elements.

In a preferred embodiment of the present invention, the press element is formed at a free end thereof with a resilient exerting arm which is obliquely extended therefrom toward the second support element.

In a preferred embodiment of the present invention, a resilient exerting arm is integrally formed on the second support element in an inclined manner so as to abut against a rear surface of the press element.

In a preferred embodiment of the present invention, the press element is formed to be curved in such a manner that a surface thereof opposite to the inner surface of the first support element is concave.

Also, in accordance with the present invention, a clip is provided. The clip includes a first support element having one end and the other end acting as a free end, and a second support element having one end and the other end acting as a free end. The first and second support elements are arranged opposite to each other. The clip also includes a connection element arranged so as to connect the one ends of the first support element and second support element to each other therethrough, so that the first support element, second support element and connection element cooperate together to form a substantially U-shape in section. The clip further includes first and second press elements each formed at a corresponding one of the free ends of the first and second support elements in a manner to be extended from the one free end trough a hinge groove. The first and second press elements are each inwardly bent at the hinge groove, so that papers or the like are inserted between the first press element and the second press element, resulting in the papers or the like being firmly interposedly held by the clip.

Further, in accordance with the present invention, a clip is provided. The clip includes a first support element made of metal and having one end and the other end acting as a free end, and a second support element made of metal and having one end and the other end acting as a free end. The first and second support elements are arranged opposite to each other. The clip also includes a connection element made of metal and arranged so as to connect the one ends of the first support element and second support element to each other therethrough, so that the first support element, second support element and connection element cooperate together to form a substantially U-shape in section. The clip further includes a press element formed at the free end of the second support element in a manner to be extended from the free end of the second support element. The press element is inwardly bent to abut at a distal end thereof against an inner surface of the first support element, whereby papers or the like are inserted between the first support element and the press element, resulting in the papers or the like being firmly interposedly held by the clip.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a clip according to the present invention will be described hereinafter with reference to the accompanying drawings.

Figure 1:
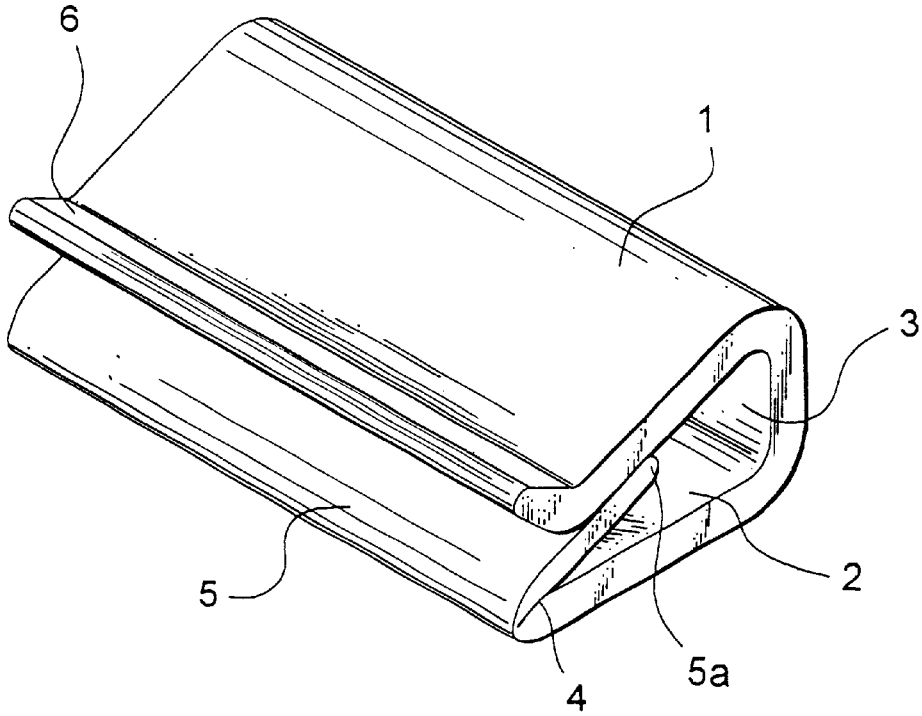
FIG. 1 is a perspective view showing an embodiment of a clip according to the present invention.
Figure 2:
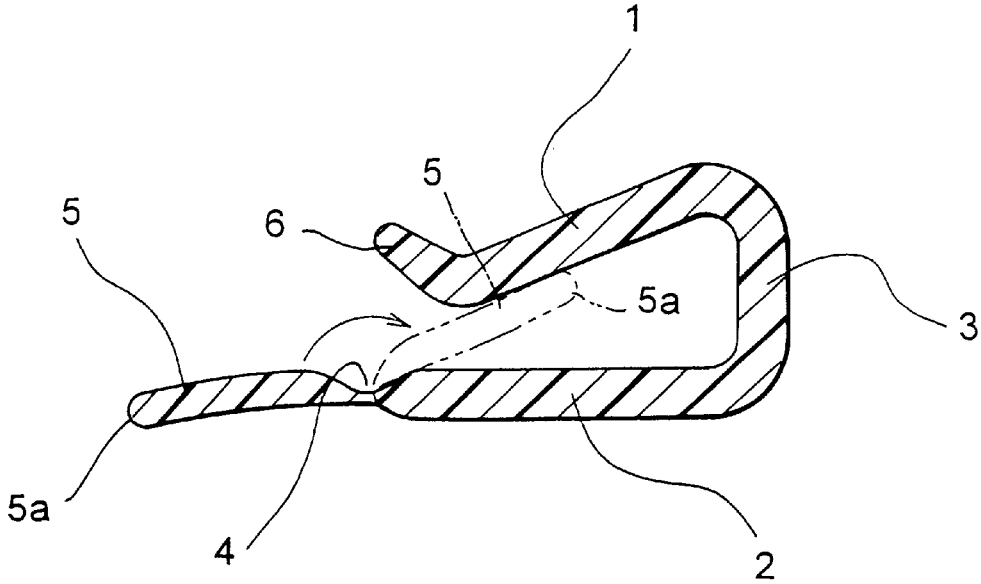
FIG. 2 is a cross-sectional view of the clip shown in FIG. 1.
Figure 3:
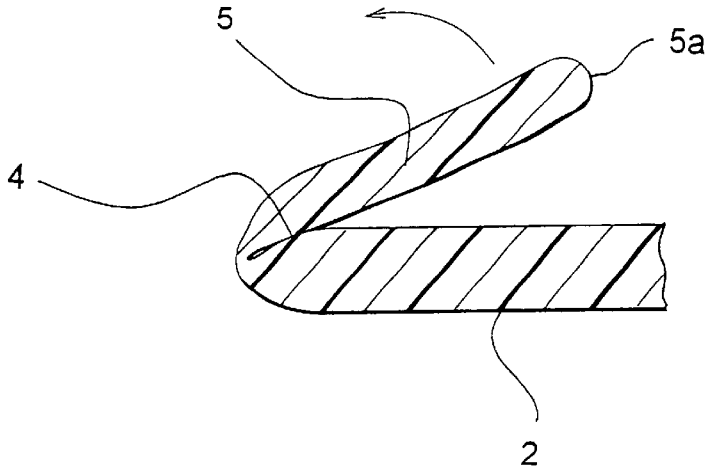
FIG. 3 is a fragmentary enlarged sectional view showing a bent section of the clip shown in FIG. 1.
Figure 4:
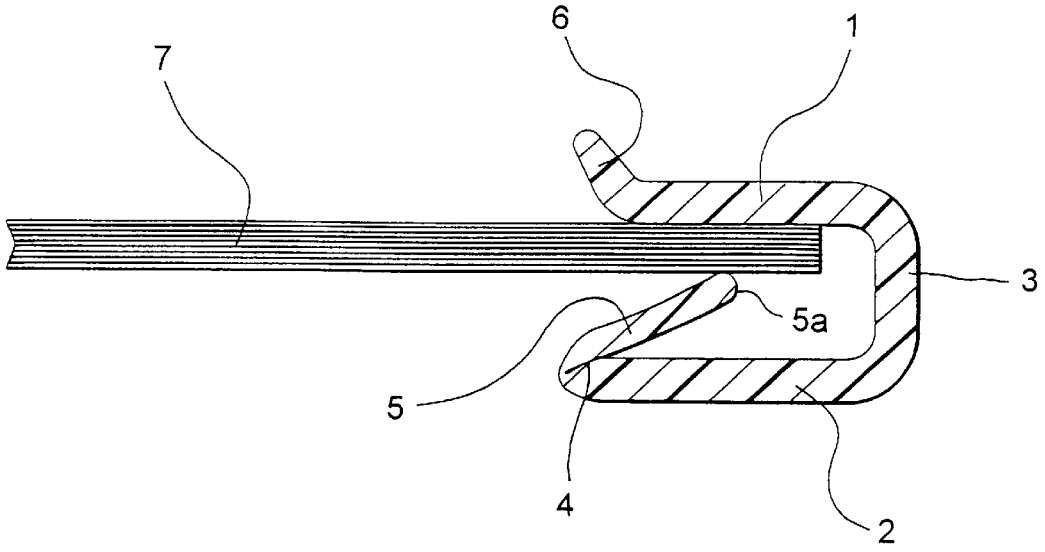
FIG. 4 is a sectional view of the clip shown in FIG. 1, in which papers are interposedly inserted.

Referring first to FIGS. 1 and 2, an embodiment of a clip according to the present invention is illustrated. A clip of the illustrated embodiment may be made of a synthetic resin material. The clip generally includes a first support element 1 and a second support element 2 arranged opposite to each other, and a connection element 3 which is so arranged that the first and second support elements 1 and 2 are connected at one end thereof to each other therethrough, resulting in being generally formed to have a substantially U-shape in section. The second support element 2 is provided on a side of the other end or free end thereof with a press element 5, with a hinge groove 4 being defined between the second support element 2 and the press element 5. The press element 5 is inwardly bent at the hinge groove 4, to thereby be abutted at a distal end 5*a* thereof against an inner surface of the first support element 1. The support element 2 and connection element 3 may be so arranged that an angle defined therebetween is orthogonal. Also, the first support element 1 and connection element 3 may be so arranged that an angle defined therebetween is acute. Thus, the first and second support elements 1 and 2 are formed to have a space therebetween which is broad on a connected side of the clip and narrow on an open side of the clip.

The press element 5 is previously positioned on an extension line of the second support element 2 as indicated at a solid line in FIG. 2 and then inwardly bent at the hinge groove 4 as indicated at phantom lines.

The first support element 1 is provided on the other end or free end thereof with a curved guide section 6. The press element 5 is curved in such a manner that a surface thereof opposite to the inner surface of the first support element 1 is concave, so that an angle defined between the inner surface of the first support element 1 and the press element 5 on an open side of the clip may be increased. Also, the press element 5 may be so formed that the distal end 5*a* thereof forms an acute angle.

The press element 5 is bent at the hinge groove 4, so that both sides of the hinge groove 4 force each other. This permits elastic force serving to return the press element 5 to the original state to act on the press element 5, so that the distal end 5*a* of the press element 5 may be forcibly pressed against the inner surface of the first support element 1.

Figure 5:
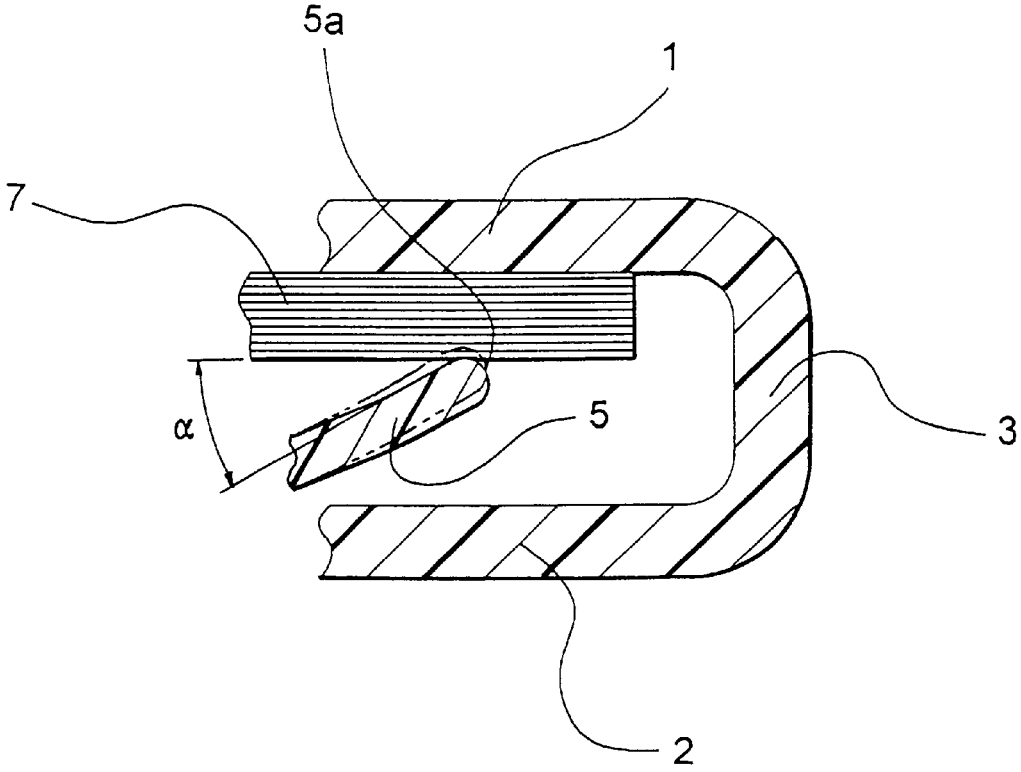
FIG. 5 is a fragmentary sectional view of the clip of FIG. 1 showing pulling-out of papers from the clip.

Now, the manner of operation of the clip of the illustrated embodiment thus constructed will be described. Papers 7 are held in the clip by merely inserting the papers 7 between the first support element 1 and the press element 5. The papers 7 are readily inserted while being guided by the guide section 6. The press element 5 is kept urged toward the first support element 1, so that the inserted papers 7 may be firmly interposedly held between the first support element 1 and the press element 5. When force acting to pull the papers 7 out of the clip is applied to the papers 7, the distal end 5*a* of the press element 5 is moved toward the open side of the clip, to thereby be raised in the clip as indicated at phantom lines in FIG. 5. This causes the space between the press element 5 and the first support element 1 to be reduced, so that pressing force against the papers 7 may be increased to render pulling-out of the papers from the clip difficult. If the press element 5 is inclined at a reduced angle, an angle between the press element 5 and the papers 7 would be reduced to decrease frictional resistance therebetween, resulting in the papers 7 being slipped with respect to the press element 5, to thereby be slippedly pulled out of the clip. However, in the clip of the illustrated embodiment, the press element 5 is curved as described above, so that an angle $\alpha$ between the press element 5 and the papers 7 may be increased, to thereby increase friction therebetween, resulting in slippage of the papers 7 with respect to the press element 5 being effectively prevented. Thus, the clip of the illustrated embodiment exhibits highly increased resistance to pulling-out of the papers 7 from the clip, to thereby positively hold the papers 7 in the clip.

Figure 6:
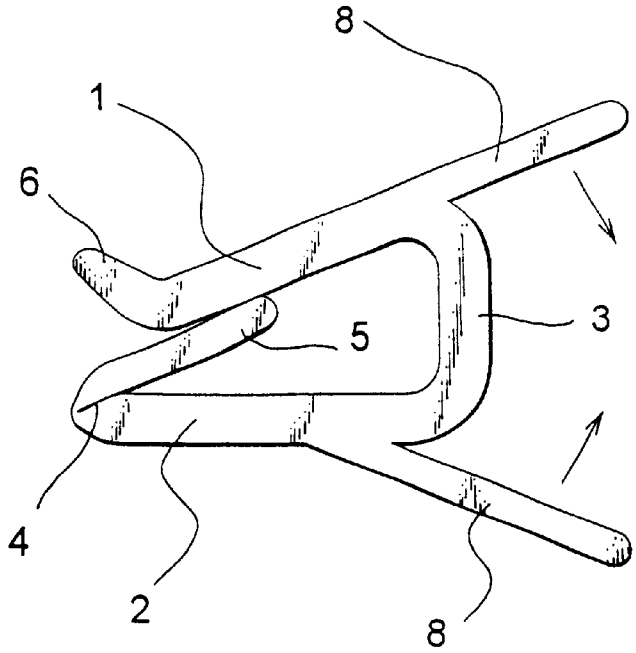
FIG. 6 is a side elevation view showing another embodiment of a clip according to the present invention.

Referring now to FIG. 6, another embodiment of a clip according to the present invention is illustrated. A clip of the illustrated embodiment is so constructed that a first support element 1 and a second support element 2 are each formed on an outer surface thereof with a held element 8 in a manner to be projected therefrom. The held elements 8 are held or pinched together and forced in a direction toward each other as indicated at arrows in FIG. 6, to thereby expand the space between the first support element 1 and press element 5, resulting in insertion and pulling-out of papers 7 with respect to the clip being facilitated. The remaining part of the illustrated embodiment may be constructed in substantially the same manner as the embodiment described above.

In the clip of each of the embodiments described above, when the press element 5 is bent, both sides of the hinge groove 4 interfere each other to permit elastic force to be exerted on a bent section of the press element 5. The elastic force causes force in a direction opposite to a direction of bending of the press element 5 to be exerted on the press element 5, so that the press element 5 may be forcibly pressed at the distal end 5*a* thereof against the inner surface of the first support element 1, so that the clip may firmly hold the papers 7.

Then, when force is applied in a direction of pulling out the papers 7 from the clip, the inclined press element 5 tends to be raised. The press element 5 is curvedly formed, so that the angle $\alpha$ between the curved press element 5 and the papers 7 may be increased as compared with when the press element 5 is not curved, resulting in friction therebetween being increased correspondingly. Also, a further increase in the angle $\alpha$ due to raising of the press element 5 leads to a synergistical increase in friction. Thus, the clip exhibits increased resistance to pulling-out of the papers therefrom.

Also, the acute angle $\alpha$ between the press element 5 and the papers 7 is preferably as large as possible. In the prior art, an increase in the angle $\alpha$ requires to increase an interval between the first support element 1 and the second support element 2. On the contrary, the first and second embodiments described above are each so constructed that the press element 5 is formed while being curved. Such construction permits the angle $\alpha$ between the press element 5 and the papers 7 to be increased without increasing the interval between the first support element 1 and the second support element 2, so that the clip may be rendered compact. This prevents the clip from being substantially increased in size even when the held elements 8 are provided on the support elements as shown in FIG. 6.

The press element 5 may be formed on an upper surface thereof or a surface thereof brought into contact with the papers 7 with a plurality of parallel grooves, to thereby further enhance friction between the press element 5 and the papers 7. Alternatively, the upper surface of the press element 5 may have a material which is increased in friction such as rubber, synthetic resin or the like attached thereto.

Figure 7:
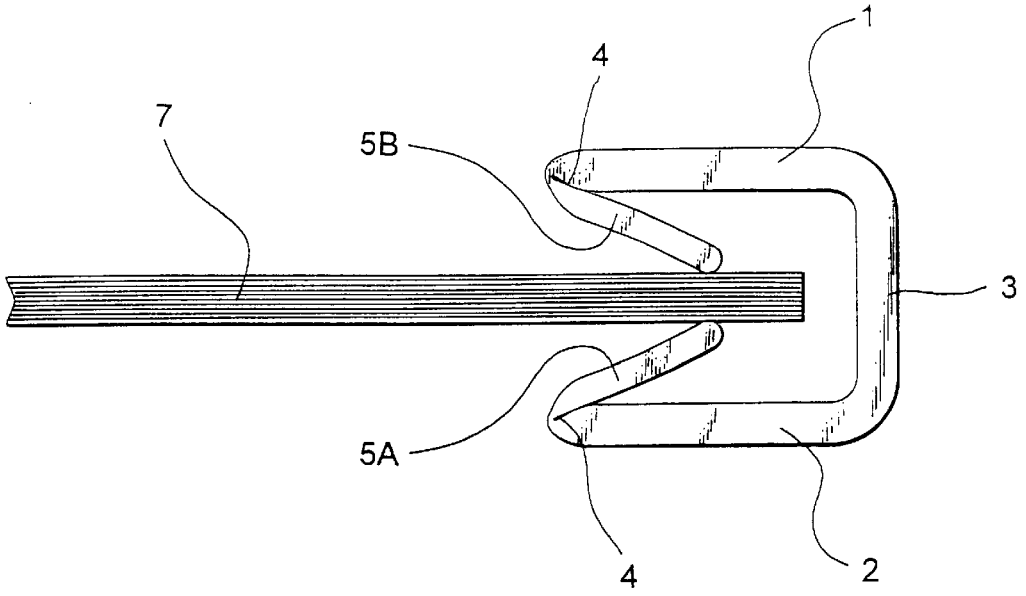
FIG. 7 is a side elevation view showing a further embodiment of a clip according to the present invention.

Referring now to FIG. 7, a further embodiment of a clip according to the present invention is illustrated. A clip of the illustrated embodiment is so constructed that a first support element 1 and a second support element 2 are each arranged so as to extend at a free end thereof through a hinge groove 4, resulting in a first press element 5A and a second press element 5B being formed, respectively. Then, the press elements 5A and 5B are each bent inwardly at the hinge groove 4. This permits papers 7 to be inserted between the first press element 5A and the second press element 5B, so that the papers 7 may be firmly clipped by the clip.

Figure 8:
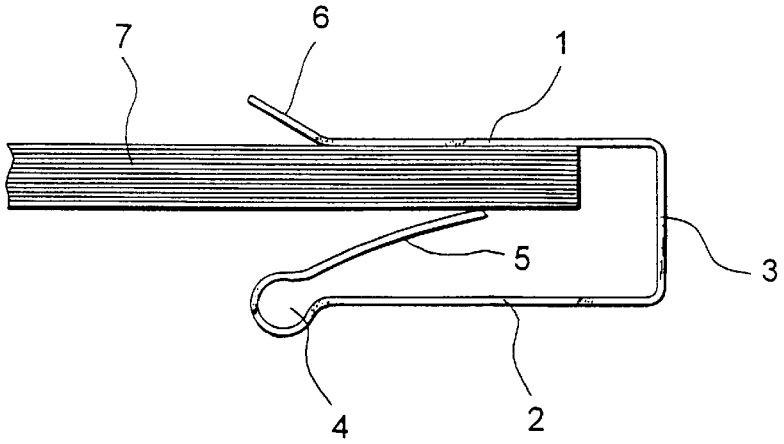
FIG. 8 is a side elevation view showing still another embodiment of a clip according to the present invention, which is made of metal.

The clip may be formed of a metal leaf spring as shown in FIG. 8. In this instance as well, the first support element 1 and second support element 2 are connected at one end thereof to each other through a connection element 3 likewise made of metal, so that the clip is formed to have a substantially U-shape in section. Also, the second support element 2 is formed so as to forwardly extend at a free end thereof, to thereby provide a press element 5, which is then bent inwardly, resulting in the press element 5 being abutted at a distal end thereof against an inner surface of the first support element 1. Formation of the clip by metal permits the clip to exhibit holding force increased as compared with that made of synthetic resin, by cooperation of the first support element 1 and press element 5. In this instance as well, two such press elements may be provided in a manner similar to that shown in FIG. 7.

Figure 9:
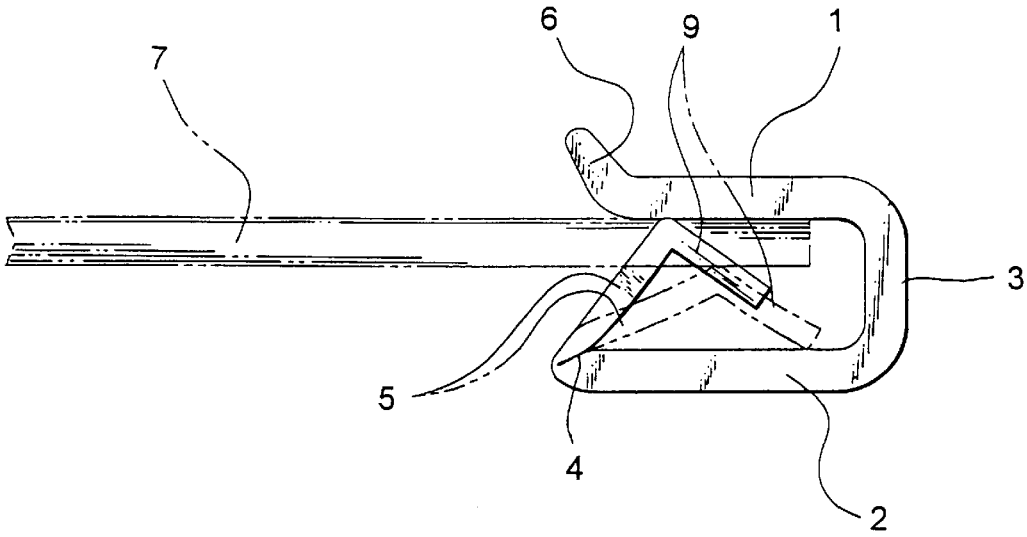
FIG. 9 is a side elevation view showing another embodiment of a clip according to the present invention.

Now, referring to FIG. 9, a further embodiment of a clip of the present invention will be described hereinafter. In the illustrated embodiment, a press element 5 is formed at a free end thereof with a resilient exerting arm 9 which is obliquely extended therefrom downwardly toward a second support element 2. Such a construction permits a distal end of the resilient exerting arm 9 to come into contact with an inner surface of the support element 2 as indicated by phantom lines in FIG. 9, when papers 7 are inserted into the clip, whereby the press element 5 becomes hard to flex, resulting in the papers 7 being strongly urged onto a first support element 1. In addition, after the papers 7 are removed, the resilient force of the resilient exerting arm 9 assists the flexed press element 5 to elastically return to its original state, so that the press element 5 can be quickly brought back into the original state as indicated by solid lines in FIG. 9, to thereby allow other papers or the like to be immediately and positively inserted and fastened. In particular, such a clip very effectively fastens thin papers after papers of a considerable thickness having been inserted therein.

Figure 10:
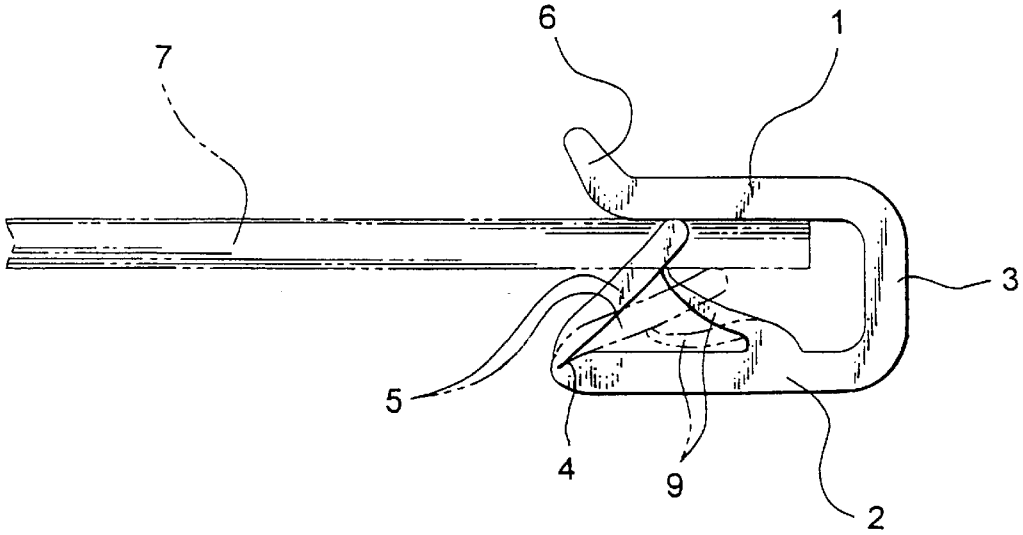
FIG. 10 is a side elevation view showing still another embodiment of a clip according to the present invention.

Alternatively, a resilient exerting arm 9 may be integrally formed on a second support element 2 in an inclined manner so as to abut against a rear surface of a press element 5, as shown in FIG. 10.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A clip comprising:

a first support element having a first end and a free end;

a second support element having a first end and a free end, said first and second support elements being arranged opposite to each other;

a connection element arranged so as to connect said first end of said first support element to said first end of said second support element so that said first support element, second support element and said connection element form a substantially U-shaped section having a connected side and an open side, wherein said first support element and said second support element are arranged so as to define a space therebetween;

a hinge groove located at said free end of said second support element, said hinge groove including an inner surface including first and second inner surface portions on either side of said hinge groove said hinge groove having a thickness smaller than a thickness of said second support element; and a press element extending from said free end of said second support element through said hinge groove, said press element being inwardly bent at said hinge groove such that said first and second inner surface portions abut against each other, and said press element further having a distal end opposite said hinge groove abutting against an inner surface of said first support element, wherein said first support element, said second support element, said connection element and said press element comprise a unitary integral structure, said hinge groove generates an elastic force acting on said press element to urge said distal end of said press element toward the inner surface of said first support element, said hinge groove including a bent portion at which said press element is inwardly bent and first and second inner surfaces located on opposite sides of said bent portion, said elastic force on said press element being generated by said first inner surface and said second inner surface exerting a force on each other, and papers are inserted between said first support element and said second support element by forcing the papers through said open narrow side between said press element and said first support element.

2. A clip as defined in claim 1, wherein said first support element includes an outer surface and said second support element includes an outer surface, and including a first hold element projecting from said outer surface of said first support element and a second hold element projecting from said outer surface of said second support element, whereby a space between said first support element and said press element is expanded by pinching said first and second hold elements.

3. A clip as defined in claim 1, including a resilient exerting arm formed at said distal end of said press element, said resilient exerting arm obliquely extending toward said second support element.

4. A clip as defined in claim 1, including a resilient exerting arm integrally formed on said second support element in an inclined manner so as to abut against a rear surface of said press element.

5. A clip as defined in claim 1, wherein said press element is formed to be curved in such a manner that a surface thereof opposite to said inner surface of said first support element is concave.

6. A clip as defined in claim 1, wherein said press element includes a concave surface facing said first support element so that an angle defined between said press element and said first support element is increased.

7. A clip as defined in claim 1, wherein said second support element is orthogonal to said connection element and said first support element is arranged at an acute angle to said connection element.

8. A claim as defined in claim 1 wherein said first support element and said second support element are arranged so as to define a space therebetween which is broad on said connected side of said clip and narrow on said open side of said clip.

9. A clip comprising:

a first support element having a first end and a free end;

a second support element having a first end and a free end, said first and second support elements being arranged opposite to each other;

a connection element arranged so as to connect said first end of said first support element to said first end of said second support element so that said first support element, second support element and connection element cooperate together to form a substantially U-shaped section; and a first hinge groove located at said free end of said first support element and including an inner first surface including first and second inner first surface portions on either side of said first hinge groove, said first hinge having a thickness smaller than a thickness of said first support element;

a second hinge groove located at said free end of said second support element and including an inner second surface including first and second inner second surface portions on either side of said second hinge groove, said second hinge having a thickness smaller than a thickness of said second support element;

a first press element extending from said free end of said first support element through said first hinge groove and having a distal end opposite said first hinge groove, said first press element being inwardly bent at said first hinge groove such that said first and second inner first surface portions abut against each other; and a second press element extending from said free end of said second support element through said second hinge groove, said second press element being inwardly bent at said second hinge groove such that said first and second inner second surface portions abut against each other, said second press element having a distal end opposite said second hinge groove abutting said distal end of said first press element, wherein said first support element, said second support element, said connection element and said first and second press elements comprise a unitary integral structure, said first and second hinge grooves generate elastic forces acting on said first and second press elements urging said first and second press elements toward each other, wherein said first hinge groove includes a bent portion at which said first press element is inwardly bent and first and second inner surfaces located on opposite sides of said bent portion and said second hinge groove includes a bent portion at which said second press element is inwardly bent and first and second inner surfaces located on opposite sides of said bent portion, said elastic force acting on said first press element being generated by said first inner surface and said second inner surface of said first hinge exerting a force on each other and said elastic force acting on said second press element being generated by said first inner surface and said second inner surface of said second hinge exerting a force on each other, and papers can be inserted between said first press element and said second press element.

* * * * *